US012117185B2

(12) United States Patent
Zhou et al.

(10) Patent No.: US 12,117,185 B2
(45) Date of Patent: Oct. 15, 2024

(54) AUXILIARY MOUNTING DEVICE AND MOUNTING AND USE METHOD FOR SADDLE WINDOW AIR CONDITIONER

(71) Applicants: QINGDAO HAIER AIR CONDITIONER GENERAL CORP., LTD., Shandong (CN); HAIER SMART HOME CO., LTD., Shandong (CN)

(72) Inventors: Shutao Zhou, Qingdao (CN); Wei Guo, Qingdao (CN); Long Zhang, Qingdao (CN)

(73) Assignees: QINGDAO HAIER AIR CONDITIONER GENERAL CORP., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 400 days.

(21) Appl. No.: 17/607,712

(22) PCT Filed: Mar. 6, 2020

(86) PCT No.: PCT/CN2020/078275
§ 371 (c)(1),
(2) Date: Oct. 29, 2021

(87) PCT Pub. No.: WO2020/220830
PCT Pub. Date: Nov. 5, 2020

(65) Prior Publication Data

US 2022/0235948 A1 Jul. 28, 2022

(30) Foreign Application Priority Data

Apr. 29, 2019 (CN) ..... 201910353223.9

(51) Int. Cl.
*F24F 1/027* (2019.01)
*F24F 13/32* (2006.01)

(52) U.S. Cl.
CPC ..... *F24F 1/027* (2013.01); *F24F 13/32* (2013.01)

(58) Field of Classification Search
CPC .... F24F 1/027; F24F 13/32; F24F 1/03; F24F 1/18; F24F 1/031
(Continued)

(56) References Cited

U.S. PATENT DOCUMENTS 2,436,713 A * 2/1948 Cody ..... F24F 13/32 62/262
2,891,754 A * 6/1959 Kuhlenschmidt ..... F24F 13/32 62/262
(Continued)

FOREIGN PATENT DOCUMENTS

BR MU 8802357 U2 9/2009
CN 101876465 A 11/2010
(Continued)

OTHER PUBLICATIONS

Kim Jae-Soon Mounts of Air Conditioner KR-0115230Y1 Jun. 28, 1995 (Year: 1995).*
(Continued)

*Primary Examiner* — Edelmira Bosques
*Assistant Examiner* — Frances F. Hamilton
(74) *Attorney, Agent, or Firm* — Alston & Bird LLP

(57) ABSTRACT

An auxiliary mounting device and a mounting and use method for a saddle window air conditioner. The auxiliary mounting device comprises a base and a bolt. The base is located below a connection section of a saddle window air conditioner, and forms a certain distance away from the connection section. One end of the bolt is connected to the base, and the other end of the bolt passes through the connection section and is threadedly connected to the connection section. During mounting, the one end of the bolt
(Continued)

and the connection section move towards each other, and the connection section gradually moves towards the direction close to the base, thereby implementing slow descending of the saddle window air conditioner.

9 Claims, 4 Drawing Sheets

(58) Field of Classification Search
USPC ..... 454/204
See application file for complete search history.

(56) References Cited

U.S. PATENT DOCUMENTS

| | | | | |
|---|---|---|---|---|
| 3,576,114 | A * | 4/1971 | Sharp | F24F 1/04 62/262 |
| 5,167,131 | A * | 12/1992 | Karkhanis | F24F 1/027 62/262 |
| 5,582,025 | A * | 12/1996 | Dubin | F24F 13/32 62/262 |
| 6,389,834 | B1 | 5/2002 | LeClear et al. | |
| 2007/0068185 | A1* | 3/2007 | Thompson | F24F 1/027 62/262 |
| 2007/0137237 | A1* | 6/2007 | Rais | F24F 1/027 62/262 |
| 2009/0107162 | A1* | 4/2009 | Su | F24F 13/32 62/263 |
| 2012/0137499 | A1* | 6/2012 | Agnihotri | F16M 13/02 248/670 |
| 2019/0063760 | A1 | 2/2019 | Li | |
| 2020/0124296 | A1* | 4/2020 | Baumann | F24F 1/027 |

FOREIGN PATENT DOCUMENTS

| | | | |
|---|---|---|---|
| CN | 202403342 | U | 8/2012 |
| CN | 104457811 | A | 3/2015 |
| CN | 107100374 | A | 8/2017 |
| CN | 107305034 | A | 10/2017 |
| CN | 206626789 | U | 11/2017 |
| CN | 207646557 | U | 7/2018 |
| CN | 108679746 | A | 10/2018 |
| CN | 108800312 | A * | 11/2018 |
| CN | 208671189 | U | 3/2019 |
| CN | 210320349 | U | 4/2020 |

OTHER PUBLICATIONS

International Search Report for PCT/CN2020/078275 (ISA/CN) mailed May 29, 2020 with English translation (5 pages).
Written Opinion for PCT/CN2020/078275 (ISA/CN) mailed May 29, 2020 with English translation (5 pages).
1st Office Action for China Patent Application No. 201910353223.9 dated Nov. 29, 2023 w/English translation (8 pages).
Search Report for China Patent Application No. 201910353993.9 dated Nov. 26, 2023 w/English translation (6 pages).

* cited by examiner

AUXILIARY MOUNTING DEVICE AND MOUNTING AND USE METHOD FOR SADDLE WINDOW AIR CONDITIONER

CROSS-REFERENCE TO RELATED APPLICATIONS

The present application is a national phase entry of International Application No. PCT/CN2020/078275, filed Mar. 6, 2020, which claims priority to Chinese Patent Application No. 201910353223.9, filed Apr. 29, 2019, which are incorporated herein by reference in their entirety.

FIELD OF THE INVENTION

The present invention relates to the technical field of window air conditioners, and in particular to an auxiliary mounting device and a mounting and use method for a saddle-type window air conditioner.

BACKGROUND OF THE INVENTION

A saddle-type window air conditioner generally includes an indoor part, an outdoor part and a connecting part. The connecting part is used to connect the indoor part and the outdoor part. The outdoor part and the indoor part are located on the same side of the connecting part. The overall appearance of the window air conditioner is in an inverted U-shaped structure. After the saddle-type window air conditioner is mounted to the window, the connecting part is located above the window, and the indoor part and the outdoor part are both located below the window, which can prevent the window air conditioner from blocking the sunlight. The saddle-type window air conditioner is now favored by more and more consumers.

Due to the unique structure of the saddle-type window air conditioner, when the window air conditioner is moved to a window and descends on the window, the window air conditioner can easily fall down suddenly, so that a large impact is generated between the connecting part and the window, thereby causing damage to the connecting part, and pipelines and devices therein.

The above information disclosed in the background art is only used to enhance the understanding of the background art of the present application, and therefore, it may include the prior art that is not known to those of ordinary skill in the art.

BRIEF DESCRIPTION OF THE INVENTION

In view of the risk of sudden falling of a saddle-type window air conditioner in the mounting process in the prior art, the present invention provides an auxiliary mounting device for a saddle-type window air conditioner, so that the saddle-type window air conditioner can slowly fall down in the mounting process through a bolt, and the auxiliary mounting device is simple in structure and convenient for operation.

In order to achieve the above invention objective, the present invention adopts the following technical solution:

The present invention provides an auxiliary mounting device for a saddle-type window air conditioner. The saddle-type window air conditioner includes an indoor part located on an indoor side, an outdoor part located on an outdoor side and a connecting part located on a window, one end of the connecting part is connected to the indoor part, and the other end of the connecting part is connected to the outdoor part.

The auxiliary mounting device includes: a base, located below the connecting part and forming a certain distance from the connecting part; and a bolt, one end of which is connected to the base, and the other end of which runs through the connecting part and is screwed with the connecting part. The bolt and the connecting part move towards each other, and the connecting part gradually moves towards a direction close to the base.

In order to realize the run-through connection between the bolt and the connecting part and avoid an extension-retraction movement of the bolt relative to the connecting part, the connecting part includes an indoor connecting box and an outdoor connecting box, the indoor connecting box is connected to the indoor part, the outdoor connecting box is connected to the outdoor part, and the outdoor connecting box is located on a periphery of the indoor connecting box. An upper side wall and a lower side wall of the indoor connecting box are respectively provided with a through hole for the bolt to run through. An upper side wall and a lower side wall of the outdoor connecting box are respectively provided with an elongated hole for the bolt to run through, and the elongated hole extends and is arranged along a length direction of the outdoor connecting box.

In order to realize screw connection between the bolt and the connecting part, the through hole is provided with a first shaft sleeve facing an inside of the indoor connecting box, the first shaft sleeve has an internal thread, and the bolt is screwed with the internal thread.

As a preferred embodiment, the first shaft sleeve is disposed on an inner side of the upper side wall of the indoor connecting box.

In order to prevent the elongated hole from limiting an extension-retraction movement range of the connecting part, the elongated hole has a first end and a second end, and the first end is close to the indoor part and is through with a side edge of the outdoor connecting box.

In order to block a connecting structure between the indoor connecting box and the outdoor connecting box to make the product more beautiful, the connecting part further includes a decorative hood, the decorative hood is disposed on a periphery of the outdoor connecting box, and the decorative hood is provided with a second through hole for the bolt to run through.

In order to prevent outside dust, foreign matters and the like from entering the inside of the connecting part, the second through hole located in an upper part of the decorative hood is detachably provided with a cover.

In order to realize a connection between the bolt and the base, one side of the base facing the connecting part is provided with a second shaft sleeve, and a lower end of the bolt is connected to the second shaft sleeve by way of interference fit.

In order to make the connecting part and the base attached to each other tightly to make the window air conditioner more stable after being located on the is window, when the connecting part abuts against the base, the second shaft sleeve runs through and is disposed in the second through hole, the elongated hole and the first through hole located in a lower part of the connecting part at the same time.

The present invention further provides a mounting and use method of the auxiliary mounting device for the saddle-type window air conditioner. The mounting and use method includes:

screwing the bolt into the connecting part from top to bottom such that the lower end of the bolt is connected to the base, the upper end of the bolt is screwed with the connecting part, and a certain distance is formed between the base and the connecting part;

moving the saddle-type window air conditioner together with the auxiliary mounting device onto a window, and placing the base on the window such that the indoor part is located on the indoor side and the outdoor part is located on the outdoor side; and screwing the bolt out of the connecting part from bottom to top such that the connecting part gradually moves towards the direction close to the base.

Compared with the prior art, the present invention has the following advantages and beneficial effects:

The present invention provides an auxiliary mounting device and a mounting and use method for a saddle-type window air conditioner. The auxiliary mounting device includes a base and a bolt. The base is located below the connecting part of the saddle-type window air conditioner and forms a certain distance from the connecting part. One end of the bolt is connected to the base, and the other end of the bolt runs through the connecting part and is screwed with the connecting part. When mounting, first, the bolt is screwed into the connecting part from top to bottom such that the lower end of the bolt is connected to the base and the upper end of the bolt is screwed with the connecting part; then the saddle-type window air conditioner together with the auxiliary mounting device is moved onto the window, and the base is located on the window; and then the bolt is screwed out of the connecting part from bottom to top such that the bolt and the connecting part move towards each other, and the connecting part gradually moves towards the direction close to the base, so as to realize the slow falling of the saddle-type window air conditioner. The auxiliary mounting device is simple in structure and convenient for operation.

After reading the specific implementation manner of the present invention in conjunction with the accompanying drawings, other characteristics and advantages of the present invention will become clearer.

BRIEF DESCRIPTION OF THE DRAWINGS

To describe the technical solutions in the embodiments of the present invention or in the prior art clearly, the following briefly describes the accompanying drawings required for describing the embodiments or the prior art. Apparently, the accompanying drawings in the following description show some embodiments of the present invention, and those of ordinary skill in the art may still derive other drawings from these accompanying drawings without creative efforts.

In the figures, 10 denotes an auxiliary mounting device, 11 denotes a base, 111 denotes a second shaft sleeve, 12 denotes a bolt, 20 denotes a saddle-type window air conditioner, 21 denotes an indoor part, 22 denotes a connecting part, 221 denotes an indoor connecting box, 222 denotes an outdoor connecting box, 223 denotes a decorative hood, 224 denotes a first shaft sleeve, 225 denotes a first through hole, 226 denotes an elongated hole, 2261 denotes an elongated hole first end, 2262 denotes an elongated hole second end, 227 denotes a second through hole, 23 denotes an outdoor part;

L denotes a length direction of the outdoor connecting box, d denotes a distance between the connecting part and the base, P denotes a plane.

DETAILED DESCRIPTION

In order to make objectives, technical solutions and advantages of embodiments of the present invention clearer, the technical solutions in the embodiments of the present invention are clearly and completely described below in conjunction with the accompanying drawings in the embodiments of the present invention, and it is apparent that the described embodiments are parts of embodiments rather than all embodiments of the present invention. All other embodiments obtained by those of ordinary skill in the art based on the embodiments of the present invention without creative efforts shall fall within the protection scope of the present invention.

It should be noted that in the description of the present invention, the terms "upper", "lower", "left", "right", "vertical", "horizontal", "inner", "outer" and the like indicating the direction or positional relationship are based on the direction or positional relationship shown in the accompanying drawings. This is only for the convenience of description, and does not indicate or imply that the device or element must have a specific orientation, or be constructed and operated in a specific orientation, and therefore cannot be understood as a limitation of the present invention. In addition, the terms "first" and "second" are only used for descriptive purposes, and cannot be understood as indicating or implying relative importance.

Figure 1:
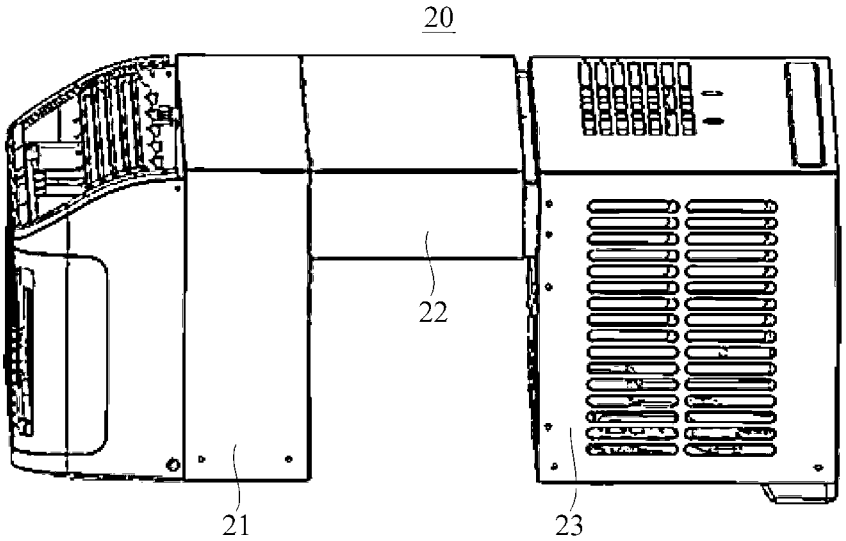
FIG. 1 is a schematic structural diagram of an embodiment of a saddle-type window air conditioner according to the present invention.
Figure 2:
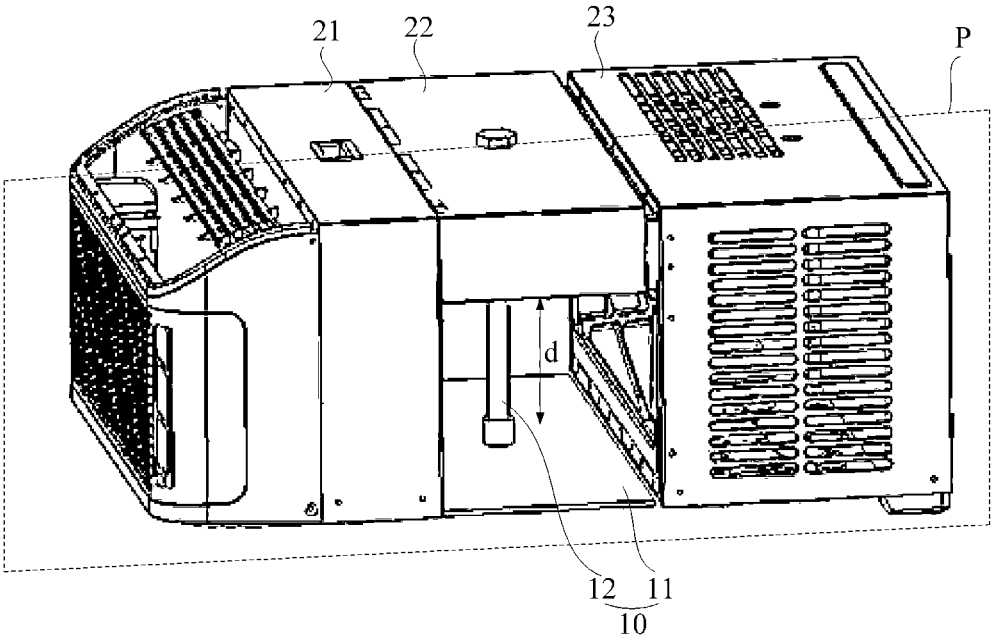
FIG. 2 is a schematic structural diagram I of an embodiment of a mounting and use method of an auxiliary mounting device for a saddle-type window air conditioner according to the present invention.
Figure 3:
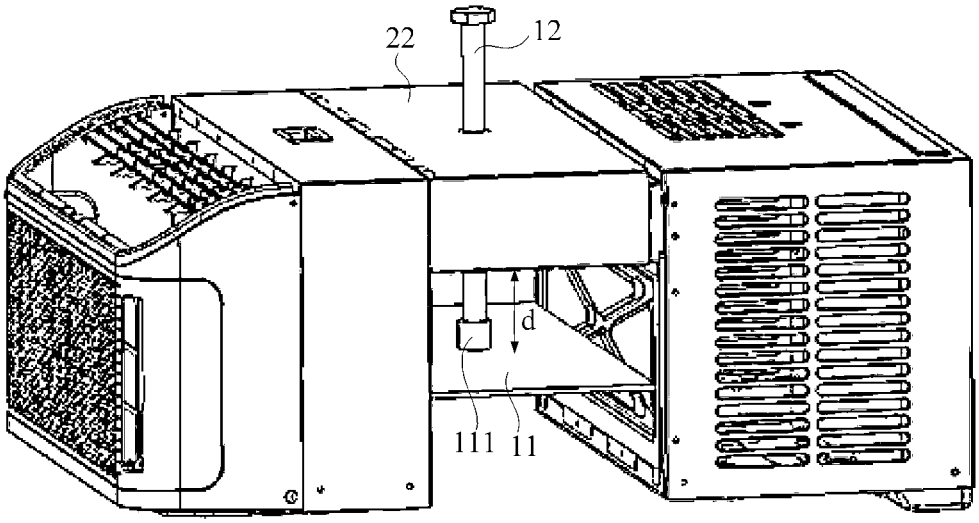
FIG. 3 is a schematic structural diagram II of the embodiment of the mounting and use method of the auxiliary mounting device for the saddle-type window air conditioner according to the present invention.

The present invention discloses an auxiliary mounting device for a saddle-type window air conditioner, applied to a mounting process of a saddle-type window air conditioner. With reference to FIG. 1, a saddle-type window air conditioner 20 includes an indoor part 21, an outdoor part 23 and a connecting part 22. The indoor part 21 is located on an indoor side and below a window. The outdoor part 23 is located on an outdoor side and below the window. The connecting part 22 is configured to connect the indoor part 21 and the outdoor part 23, and the overall appearance of the window air conditioner is in an inverted U-shaped structure. The connecting part 22 is available in two forms: retractable and non-retractable. When the retractable mode is used, the connecting part 22 has an adjustable length to adapt to windows of different sizes. After the saddle-type window air conditioner 20 is mounted to the window, the connecting part 22 is located on the window, and the indoor part 21 and the outdoor part 23 are both located below the window, which can prevent the window air conditioner from blocking sunlight. In this embodiment, preferably, the connecting part 22 is in a retractable mode. When mounting the saddle-type window air conditioner 20, first, the length of the connecting part 22 is stretched, and the stretched saddle-type window air conditioner 20 is moved onto the window such that the indoor part 21 is located on the indoor side and the outdoor part 23 is located on the outdoor side; then the saddle-type window air conditioner 20 is made to fall down such that the connecting part 22 is located on the window; and finally, the length of the connecting part 22 is adjusted to adapt to the corresponding window size.

With reference to FIG. 2 to FIG. 5, the auxiliary mounting device 10 for the saddle-type window air conditioner includes a base 11 and a bolt 12. The base 11 is located below the connecting part 22, and a certain distance d is formed between the base 11 and the connecting part 22. One end of the bolt 12 is connected to the base 11, and the other end of the bolt 12 runs through the connecting part 22 and is screwed with the connecting part 22. At the time of mounting and use, the auxiliary mounting device 10 is fixedly mounted onto the saddle-type window air conditioner 20, the distance d is formed between the base 11 and a lower surface of the connecting part 22, and a lower surface of the base 11 is on the same plane or nearly on the same plane as a lower surface of the indoor part 21 and a lower surface of the outdoor part 23. The saddle-type window air conditioner 20 together with the auxiliary mounting device 10 is moved onto the window, and the base 11 is placed on the window, such that the indoor part 21 is located on the indoor side and the outdoor part 23 is located on the outdoor side. At this time, the bolt 12 is equivalent to an ejector rod, such that the connecting part 22 of the saddle-type window air conditioner 20 is kept at a height d from the base 11, that is, the saddle-type window air conditioner 20 is kept at a certain height from the window. The bolt 12 is screwed, such that the bolt 12 is screwed out of the connecting part 22, and the base 11 moves together with the bolt 12. As the screw-out movement of the bolt 12, the bolt 12 and the connecting part 22 move towards each other, and the connecting part 22 gradually moves towards the direction close to the base 11, that is, the distance d between the base 11 and the lower surface of the connecting part 22 gradually decreases, so as to realize the slow falling of the saddle-type window air conditioner 20. The auxiliary mounting device 10 is simple in structure and convenient for operation.

In order to realize retractability of the connecting part 22, the connecting part 22 includes an indoor connecting box 221 and an outdoor connecting box 222. One end of the indoor connecting box 221 is fixedly connected to the indoor part 21 by means of screws, buckles or the like, and one end of the outdoor connecting box 222 is fixedly connected to the outdoor part 23 by means of screws, buckles or the like. As a preferred embodiment, the outdoor connecting box 222 is located on a periphery of the indoor connecting box 221, to prevent outside dust, foreign matters and the like from entering the indoor through a gap between the indoor connecting box 221 and the outdoor connecting box 222, and meanwhile to make the product more beautiful. One end of the bolt 12 runs through the connecting part 22, that is, one end of the bolt 12 runs through and is disposed in the indoor connecting box 221 and the outdoor connecting box 222 at the same time. As a preferred embodiment, an upper side wall and a lower side wall of the indoor connecting box 221 are respectively provided with a first through hole 225 for the bolt 12 to run through. An upper side wall and a lower side wall of the outdoor connecting box 222 are respectively provided with an elongated hole 226 for the bolt 12 to run through, the elongated hole 226 extends and is arranged along a length direction L of the outdoor connecting box 222, and the bolt 12 runs through and is disposed in the first through hole 225 and the elongated hole 226 at the same time. In this embodiment, when the connecting part 22 is extended and retracted to adjust the length dimension, a relative movement is generated between the indoor connecting box 221 and the outdoor connecting box 222, to drive the bolt 12 to make a linear motion along the elongated hole 226. The elongated hole 226 ensures that the bolt 12 can run through the connecting part 22, and meanwhile can also prevent the bolt 12 from affecting the relative movement between the indoor connecting box 221 and the outdoor connecting box 222, so as to realize that the length of the connecting part 22 can be adjusted. In the meanwhile, the fit between the bolt 12 and the elongated hole 226 also performs a certain guiding function on the relative movement between the indoor connecting box 221 and the outdoor connecting box 222.

Figure 6:
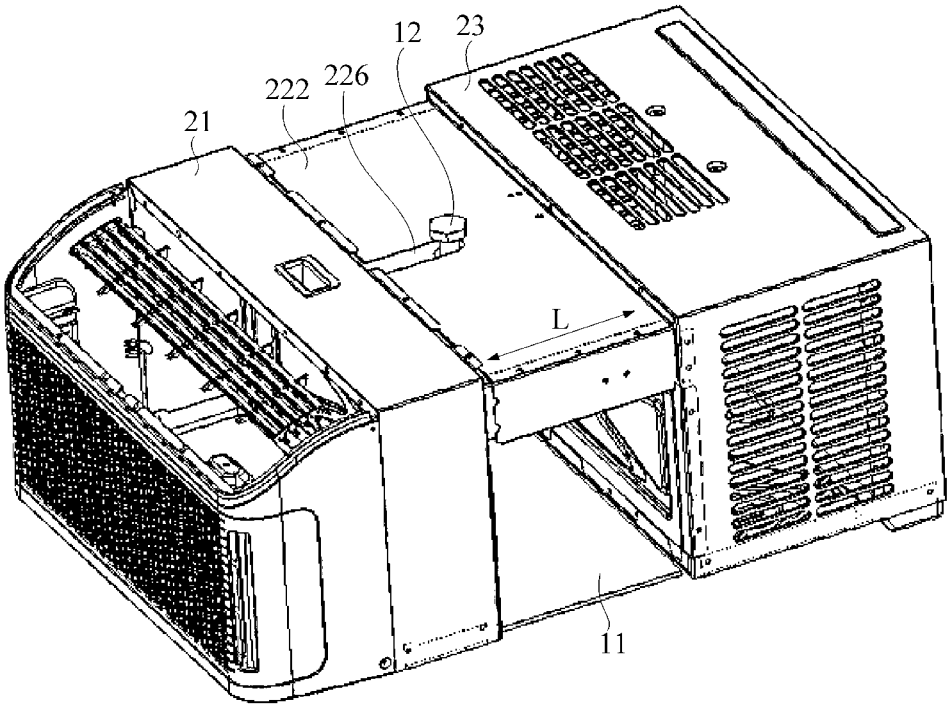
FIG. 6 is a schematic structural diagram I of an embodiment of an auxiliary mounting device for a saddle-type window air conditioner with a decorative hood omitted according to the present invention.
Figure 7:
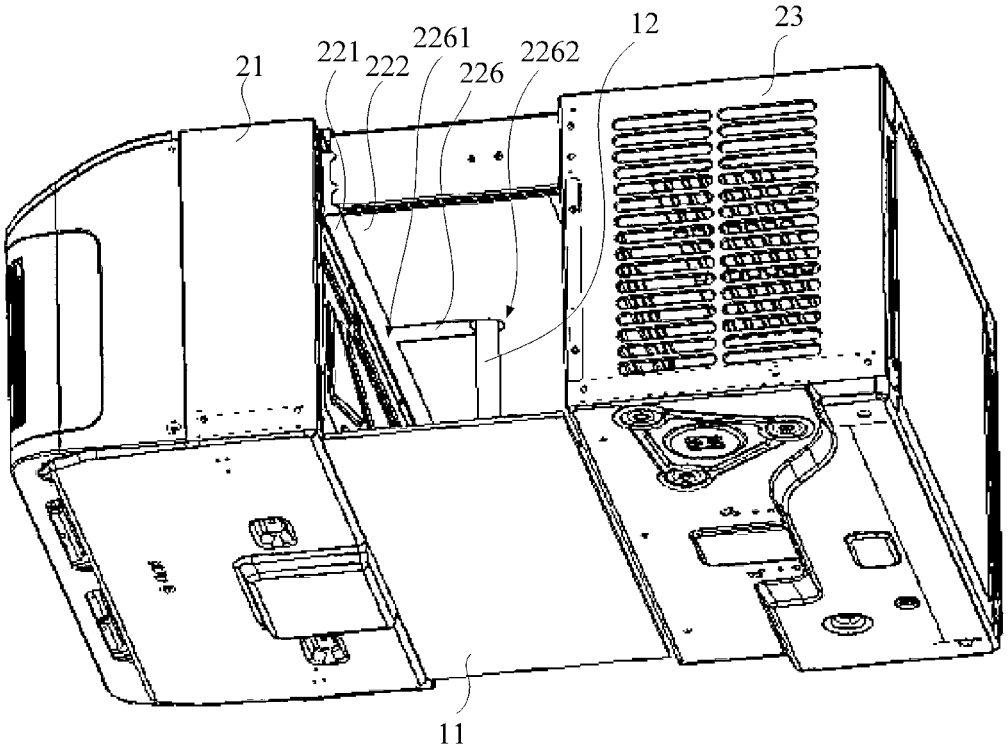
FIG. 7 is a schematic structural diagram II of the embodiment of the auxiliary mounting device for the saddle-type window air conditioner with the decorative hood omitted according to the present invention.

The elongated hole 226 has a first end and a second end. The end of the elongated hole 226 close to the indoor part 21 is defined as the elongated hole first end 2261, and the end close to the outdoor part 23 is defined as the elongated hole second end 2262. In order to further ensure that the bolt 12 does not affect the relative movement between the indoor connecting box 221 and the outdoor connecting box 222, the elongated hole first end 2261 is set to be through with a side edge of the outdoor connecting box 222. The "side edge of the outdoor connecting box 222" here refers to the side edge of the outdoor connecting box 222 close to the indoor part 21. With reference to FIG. 6 and FIG. 7, when the indoor connecting box 221 and the outdoor connecting box 222 move towards each other until the bolt 12 abuts against the elongated hole second end 2262, the connecting part 22 has the smallest length at this time. When the indoor connecting box 221 and the outdoor connecting box 222 move away from each other, the bolt 12 moves from the elongated hole second end 2262 towards the direction of the elongated hole first end 2261, and the length of the connecting part 22 is gradually stretched and lengthened. Since the elongated hole first end 2261 is through with the side edge of the outdoor connecting box 222 close to the indoor part 21, the movement away from each other between the indoor connecting box 221 and the outdoor connecting box 222 is not affected by the length of the elongated hole 226.

The first through hole 225 is provided with a first shaft sleeve 224 facing an inside of the indoor connecting box 221, the first shaft sleeve 224 has an internal thread, and the bolt 12 is screwed with the internal thread, so as to realize screw connection between the bolt 12 and the connecting part 22. The first shaft sleeve 224 is disposed inside the indoor connecting box 221, which may also prevent the first shaft sleeve 224 from affecting the relative movement between the indoor connecting box 221 and the outdoor connecting box 222.

In order to make the product beautiful, in this embodiment, the connecting part 22 further includes a decorative hood 223. The decorative hood 223 is disposed on a periphery of the outdoor connecting box 222 to block a connecting structure between the indoor connecting box 221 and the outdoor connecting box 222. The bolt 12 runs through and is disposed in the indoor connecting box 221 and the outdoor connecting box 222, and meanwhile also runs through and is disposed in the decorative hood 223. The decorative hood 223 is provided with a second through hole 227 corresponding to the first through hole 225, and the bolt 12 runs through the second through hole 227. When the indoor connecting box 221 and the outdoor connecting box 222 move relatively to adjust the length, the decorative hood 223 may further block the elongated hole 226. In order to facilitate the expression of the connecting structure between the bolt 12 and the indoor connecting box 221 and the outdoor connecting box 222, the decorative hood 223 is omitted in FIG. 6 and FIG. 7.

The second through hole 227 located in an upper part of the decorative hood 223 is detachably provided with a cover (not shown in figures). When the bolt 12 is screwed out and demounted from the connecting part 22, the cover seals the second through hole 227, so as to prevent outside dust, foreign matters and the like from entering the inside of the connecting part 22 through the second through hole 227. The cover is an elastic rubber cover, and the rubber cover is connected to the second through hole 227 by way of interference fit, and thus, the rubber cover is simple in structure and convenient for mounting and demounting.

One side of the base 11 facing the connecting part 22 is provided with a second shaft sleeve 111, that is, an upper surface of the base 11 is provided with the second shaft sleeve 111, the second shaft sleeve 111 is an elastic rubber member, and the lower end of the bolt 12 is connected to the second shaft sleeve 111 by way of interference fit. When the bolt 12 runs into the connecting part 22 from top to bottom, the lower end of the bolt 12 moves downward to be inserted into the second shaft sleeve 111, so as to realize the fixed connection between the bolt 12 and the base 11. When the bolt 12 is screwed out from bottom to top, the base 11 moves upward along with the bolt 12. When the base 11 moves along with the bolt 12 to abut against the lower surface of the connecting part 22, the second shaft sleeve 111 is sequentially inserted into the second through hole 227, the elongated hole 226 and the first through hole 225 located in a lower part of the connecting part, and then is screwed upward out of the bolt 12. The lower end of the bolt 12 is separated and extracted from the second shaft sleeve 111 until the bolt 12 is completely separated from the connecting part 22.

As a preferred embodiment, the first shaft sleeve 224 is only disposed on an inner side of the upper side wall of the indoor connecting box 221, so that the second shaft sleeve 111 can be smoothly inserted into the lower part of the connecting part 22, so as to make the base 11 and the lower surface of the connecting part 22 attached to each other tightly and to make the saddle-type window air conditioner 20 more stable after being located on the window. At the same time, the inserted second shaft sleeve 111 also seals the second through hole 227, the elongated hole 226 and the first through hole 225, thereby preventing outside dust, foreign matters and the like from entering the inside of the connecting part 22.

When the second shaft sleeve 111 is inserted into the connecting part 22, as a preferred embodiment, an upper end surface of the second shaft sleeve 111 abuts against a lower end surface of the first shaft sleeve 224, which can further prevent outside dust, foreign matters and the like from entering the inside of the connecting part 22, and meanwhile can also prevent operating noise of the saddle-type window air conditioner 20 from coming out through middle holes of the first shaft sleeve 224 and the second shaft sleeve 111, thereby being beneficial to reducing the operating noise.

A back plate of the indoor part 22 and a back plate of the outdoor part 23 are respectively provided with a limit piece (not shown in the figures) to limit the base 11. When the bolt 12 is screwed in from top to bottom, the base 11 moves downward along with the bolt 12. When the base 11 moves downward to abut against the limit piece, the base 11 moves into place. At this time, the screw-in action of the bolt 12 may be stopped, and the auxiliary mounting device 10 is mounted in place.

After the auxiliary mounting device 10 is fixedly mounted to the saddle-type window air conditioner 20, the lower surface of the base 12 is retracted into the lower surface of the indoor part 21 and the lower surface of the outdoor part 23. Thus, an inverted U-shaped structure with a smaller height is formed between the base 12 and the indoor part 21 and the outdoor part 23. When the saddle-type window air conditioner 20 together with the auxiliary mounting device 10 is placed onto the window, the inverted U-shaped structure with a smaller height performs functions of locating and clamping to some extent, that is, the saddle-type window air conditioner 20 is preliminarily located and clamped onto the window. Therefore, when the saddle-type window air conditioner 20 slowly moves downward, it may be ensured that the indoor part 21 after falling down is located on the indoor side without generating movement interference with the window, and that the outdoor part 23 is located on the outdoor side without generating movement interference with the window.

This embodiment further discloses a mounting and use method of the auxiliary mounting device for the saddle-type window air conditioner, including:

The bolt 12 is screwed into the connecting part 22 from top to bottom such that the lower end of the bolt 12 is connected to the base 11, the upper end of the bolt 12 is screwed with the connecting part 22, and a certain distance d is formed between the base 11 and the connecting part 22. The base 11 gradually moves downward along with the screw-in movement of the bolt 12, and the distance d between the base 11 and the connecting part 22 gradually increases, with reference to FIG. 2.

The saddle-type window air conditioner 20 together with the auxiliary mounting device 10 is moved onto a window, and the base 11 is located on the window such that the indoor part 21 is located on the indoor side and the outdoor part 23 is located on the outdoor side.

The bolt 12 is screwed out of the connecting part 22 from bottom to top, and the connecting part 22 gradually moves towards the direction close to the base 11 along with the screw-out movement of the bolt 12. In other words, the connecting part 22 gradually moves downward along with the screw-out movement of the bolt 12, that is, the overall saddle-type window air conditioner 20 gradually moves downward, and the distance d between the base 11 and the connecting part 22 gradually decreases, with reference to FIG. 3.

Figure 4:
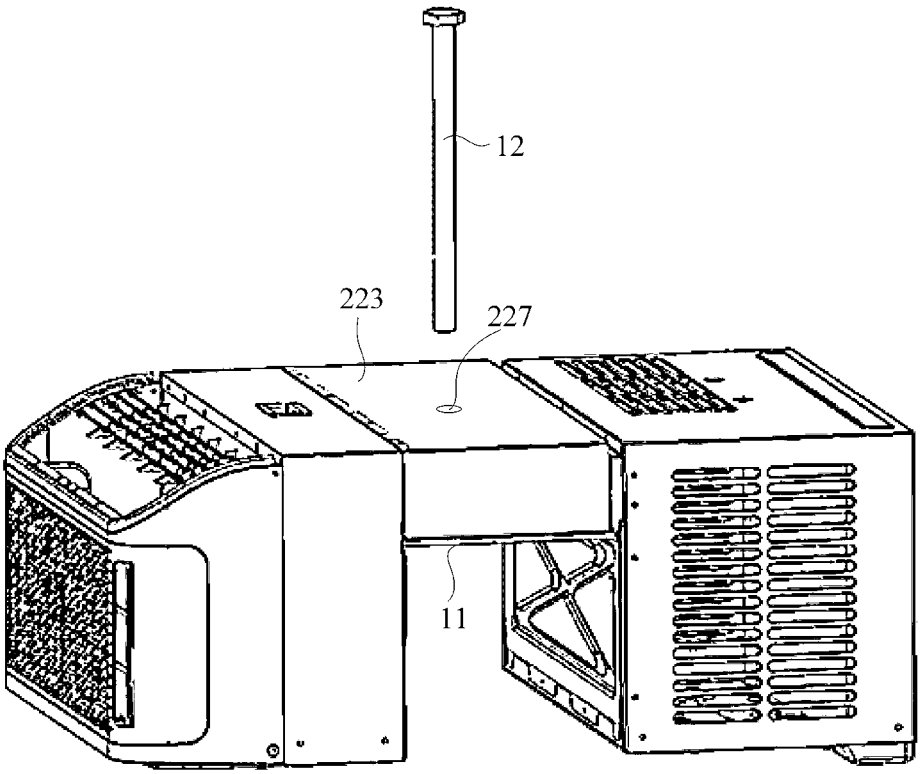
FIG. 4 is a schematic structural diagram III of the embodiment of the mounting and use method of the auxiliary mounting device for the saddle-type window air conditioner according to the present invention.
Figure 5:
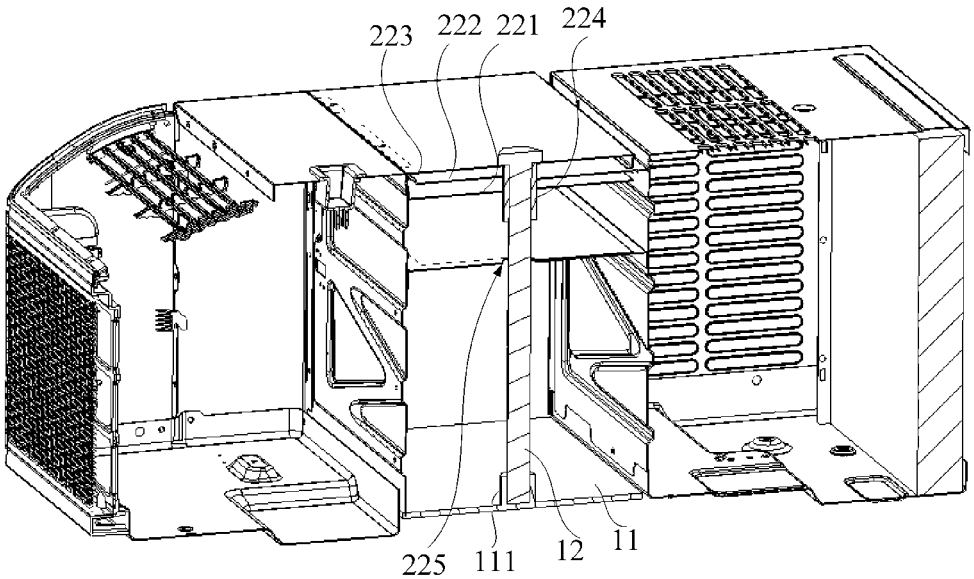
FIG. 5 is a schematic cross-sectional view of FIG. 2 along plane P.

When the connecting part 22 moves downward to abut against the upper surface of the base 11, the saddle-type window air conditioner 20 is mounted in place, and then, the bolt 12 is screwed out and demounted from the connecting part 22, with reference to FIG. 4.

As a preferred embodiment, the mounting and use method further includes:

The cover is inserted into the second through hole 227 located in the upper part of the decorative hood 223.

It should be illustrated finally that, the above embodiments are only used for illustrating the technical solutions of the present invention, and are not intended to limit the present invention. Although the present invention is illustrated in detail with reference to the foregoing embodiments, it should be understood by those skilled in the art that, modifications may still be made on the technical solutions recited in the foregoing embodiments, or equivalent replacements are made on part of the technical features; and these modifications or replacements do not make the essence of the corresponding technical solutions break away from the spirit and scope of the technical solution of the various embodiments of the present invention.

The invention claimed is:

1. An auxiliary mounting device for a saddle-type window air conditioner, wherein the saddle-type window air conditioner comprises an indoor part located on an indoor side, an outdoor part located on an outdoor side and a connecting part located on a window, one end of the connecting part is connected to the indoor part, and the other end of the connecting part is connected to the outdoor part;

wherein the auxiliary mounting device comprises:

a base, located below the connecting part and forming a certain distance from the connecting part; and a bolt, one end of which is connected to the base, and the other end of which runs through the connecting part and is screwed with the connecting part;

wherein the one end of the bolt and the connecting part move towards each other, and the connecting part gradually moves towards a direction close to the base when the bolt is screwed out of the connecting part from bottom to top, wherein the connecting part comprises an indoor connecting box and an outdoor connecting box, the indoor connecting box is connected to the indoor part, the outdoor connecting box is connected to the outdoor part, and the outdoor connecting box is located on a periphery of the indoor connecting box;

an upper side wall and a lower side wall of the indoor connecting box are respectively provided with a first through hole for the bolt to run through; and an upper side wall and a lower side wall of the outdoor connecting box are respectively provided with an elongated hole for the bolt to run through, and the elongated hole extends and is arranged along a length direction of the outdoor connecting box.

2. The auxiliary mounting device for the saddle-type window air conditioner according to claim 1, wherein the elongated hole has a first end and a second end, and the first end is close to the indoor part and is through with a side edge of the outdoor connecting box.

3. A mounting and use method of the auxiliary mounting device for the saddle-type window air conditioner according to claim 1, wherein the mounting and use method comprises:

screwing the bolt into the connecting part from top to bottom such that the lower end of the bolt is connected to the base, the upper end of the bolt is screwed with the connecting part, and a certain distance is formed between the base and the connecting part;

moving the saddle-type window air conditioner together with the auxiliary mounting device onto a window, and placing the base on the window such that the indoor part is located on the indoor side and the outdoor part is located on the outdoor side; and screwing the bolt out of the connecting part from bottom to top such that the connecting part gradually moves towards the direction close to the base.

4. The auxiliary mounting device for the saddle-type window air conditioner according to claim 1, wherein the connecting part further comprises a decorative hood, the decorative hood is disposed on a periphery of the outdoor connecting box, and the decorative hood is provided with a second through hole for the bolt to run through.

5. The auxiliary mounting device for the saddle-type window air conditioner according to claim 4, wherein the second through hole located in an upper part of the decorative hood is detachably provided with a cover.

6. The auxiliary mounting device for the saddle-type window air conditioner according to claim 1, wherein the first through hole is provided with a first shaft sleeve facing an inside of the indoor connecting box, the first shaft sleeve has an internal thread, and the bolt is screwed with the internal thread.

7. The auxiliary mounting device for the saddle-type window air conditioner according to claim 6, wherein the first shaft sleeve is disposed on an inner side of the upper side wall of the indoor connecting box.

8. The auxiliary mounting device for the saddle-type window air conditioner according to claim 6, wherein one side of the base facing the connecting part is provided with a second shaft sleeve, and a lower end of the bolt is connected to the second shaft sleeve by way of interference fit.

9. The auxiliary mounting device for the saddle-type window air conditioner according to claim 8, the connecting part further comprises a decorative hood, the decorative hood is disposed on a periphery of the outdoor connecting box, and the decorative hood is provided with a second through hole for the bolt to run through, and wherein when the connecting part abuts against the base, the second shaft sleeve runs through and is disposed in the second through hole, the elongated hole and the first through hole located in a lower part of the connecting part at the same time.

* * * * *